US008689621B2

(12) United States Patent
Godager

(10) Patent No.: US 8,689,621 B2
(45) **Date of Patent: *Apr. 8, 2014**

(54) METHOD AND APPARATUS FOR IN-SITU WELLBORE MEASUREMENTS

(75) Inventor: Oivind Godager, Sandefjord (NO)

(73) Assignee: Sensor Developments AS, Sandefjord (NO)

( * ) Notice: Subject to any disclaimer, the term of this patent is extended or adjusted under 35 U.S.C. 154(b) by 368 days.

This patent is subject to a terminal disclaimer.

(21) Appl. No.: 13/143,778

(22) PCT Filed: Jan. 7, 2010

(86) PCT No.: PCT/GB2010/000003

§ 371 (c)(1),
(2), (4) Date: Sep. 19, 2011

(87) PCT Pub. No.: WO2010/079320

PCT Pub. Date: Jul. 15, 2010

(65) Prior Publication Data

US 2012/0024050 A1 Feb. 2, 2012

(30) Foreign Application Priority Data

Jan. 12, 2009 (GB) ..... 0900446.6
Nov. 25, 2009 (GB) ..... 0920674.9

(51) Int. Cl.
*E21B 47/00* (2012.01)

(52) U.S. Cl.
USPC ..... 73/152.54

(58) Field of Classification Search
USPC ..... 73/152.51, 152.54
See application file for complete search history.

(56) References Cited

U.S. PATENT DOCUMENTS

| | | | | |
|---|---|---|---|---|
| 5,260,661 | A | 11/1993 | Vail, III | |
| 5,553,492 | A | 9/1996 | Barrett et al. | |
| 5,941,307 | A | 8/1999 | Tubel | |
| 6,070,662 | A | 6/2000 | Ciglenec et al. | |
| 6,464,021 | B1 | 10/2002 | Edwards | |
| 6,513,596 | B2 | 2/2003 | Wester | |
| 7,140,434 | B2 * | 11/2006 | Chouzenoux et al. | 166/250.11 |
| 7,602,668 | B2 * | 10/2009 | Liang et al. | 367/25 |
| 7,703,515 | B2 | 4/2010 | Chouzenoux et al. | |
| 2001/0035288 | A1 | 11/2001 | Brockman et al. | |
| 2003/0058125 | A1 | 3/2003 | Ciglenec et al. | |
| 2004/0094303 | A1 | 5/2004 | Brockman et al. | |
| 2004/0238166 | A1 * | 12/2004 | Salamitou et al. | 166/255.1 |
| 2006/0005965 | A1 | 1/2006 | Chouzenoux et al. | |
| 2007/0206440 | A1 * | 9/2007 | Fripp et al. | 367/81 |

(Continued)

FOREIGN PATENT DOCUMENTS

| | | | |
|---|---|---|---|
| GB | 2353546 | | 2/2001 |
| WO | 0165069 | A1 | 9/2001 |
| WO | 03056692 | A1 | 7/2003 |

*Primary Examiner* — John Fitzgerald
(74) *Attorney, Agent, or Firm* — Reinhart Boerner Van Deuren s.c.

(57) ABSTRACT

An apparatus and method to monitor parameters outside the wellbore casing of a well includes a Wireless Sensor Unit located outside a section of a non-magnetic casing of the well. The Wireless Sensor Unit includes a sensor device to measure parameters of the surroundings. The apparatus further includes an internal Sensor Energizer Unit inside the wellbore casing used for power and communication with the Wireless Sensor Unit. The Sensor Energizer Unit and the Wireless Sensor Unit are arranged to be at the same elevation, and they communicate data using electromagnetic modulation techniques.

52 Claims, 8 Drawing Sheets

(56) References Cited

U.S. PATENT DOCUMENTS

2008/0106972 A1 5/2008 Liang et al.
2008/0277941 A1 11/2008 Bowles et al.
2012/0024050 A1* 2/2012 Godager ..... 73/152.05
2013/0110402 A1* 5/2013 Godager ..... 702/7

* cited by examiner

METHOD AND APPARATUS FOR IN-SITU WELLBORE MEASUREMENTS

BACKGROUND OF THE INVENTION

Field of the Invention

This invention relates generally to a method and apparatus for in-situ wellbore measurements for the monitoring and control of oil and gas production, injection and observation wells, and more particularly to a method and apparatus to monitor wellbore and formation parameters in-situ with operating means wirelessly installed behind the wellbore casing or production barrier, without the need for a cable or cord to provide power, and without compromising the pressure integrity of the well or well design in any way.

The management of oil and gas as well as storage type reservoirs constitutes an ongoing concern of the petroleum industry. Those concerns are mainly due to the enormous monetary expenses involved in manufacturing and running any type of petroleum well as well as the risks associated with workovers and recompletions. Herein, a petroleum type well is defined as any type of well that is drilled and equipped for the purpose of producing or storage of hydrocarbon fractures from or to subsurface formations. Further, petroleum type wells are categorized as any of or combination, storage, observation, producing, or injection type wells.

Modern reservoir management systems more and more look into the advancement of including measurements from outside of the wellbore casing. Measurements close as well as far from the wellbore are being considered. Thus the prospect and purpose of formation parameter monitoring has become more complex than was previously the case. As with the industry in general, the motivation is to fully understand the physical properties and geometry of the reservoir as this in the long term contributes to extending the lifetime of the well as well as production yields.

There are numerous prior art patents related to the measurement of parameters outside the well casing annuli. One system that is close is described in U.S. Pat. No. 6,513,596, to Wester. The system described is illustrative in nature and shows a well data monitoring system with sensors placed inside the outer annuli of a well casing program. The system is a non-intrusive approach to measure pressure and other parameters within a plurality of annuli spaces and preserves the pressure containing integrity of the well. The system shows sensors placed inside the annuli that communicate with an interrogation system located externally or internally of the wellhead housing. It confirms that the sensors will require power and communication to perform that operation and lists generally alternative sources to power and methods of communication without solving the actual challenges of how to implement it in a real world application. This method is not believed to have been installed in any petroleum well or field.

Another related approach is described by U.S. Pat. No. 7,703,515, to Chouzenoux et al. The method described by this patent is magnetic saturation of the well casing or conduit to make a "window" for operating locally an AC magnetic field to excite a sensor located outside a casing. The principle described is not considered realistic due to a relatively high power consumption required to magnetically saturate the well casing. Further, the method would require uniform current flux within the material to be saturated, which in turn would require optimum contact (evenly distributed contact resistance over the exposed area) performance of the electrodes implied. Due to a combination of exposed electrodes and high currents, such a system would rapidly degrade due to galvanic reactions (oxidation/corrosion) inside the pressure containment system of a well. Thus, the method is considered non-applicable for a prescribed permanent wellbore measurement application due to exposed electrodes and the high current density required to magnetically saturate the wellbore casing permanently. Further, it has not been demonstrated nor believed that this method and apparatus would work in a multi-sensor configuration to provide a common infrastructure to enable placement of in-situ wellbore sensors at different zones of investigation like the present invention.

SUMMARY OF THE INVENTION

The present invention leads to better interpretation of process or formation parameters, since the sensors are placed closer to or in direct contact with the investigation zone of interest. The apparatus involved enables parameters to be measured simultaneously inside and outside of the wellbore casing. The sensor closeness to formation and the overall performance of the data acquisition enable the operator to better distinguish whether a change in physical parameter measured is caused by a change of the physical parameter itself or whether it is caused by process or environmental fluctuations.

The invention also includes telemetry for the communication from surface to downhole as well as a combined "power harvesting" and telemetry device for communicating with the wireless sensor unit that is located behind the well casing or barrier. The surface-to-downhole power and telemetry link enables numerous sensor units to be attached and operated on the same downhole cable. This network configuration enables in-situ monitoring of wellbore parameters of different zones in one and the same wellbore.

There are numerous formation parameters that may be of interest when having sensor technology available for looking into the formation side of the casing as in the present invention. Thus, the sensor measurement technology proposed applies to any type formation measurements such as, for example, resistivity, multi-axes seismic, radiation, pressure, temperature, and chemical means, to mention a few. For the purpose of this invention, we have chosen a specific measurement application in order to display the features and functionality of the present invention. Thus, the process example for the continuing discussion is the art to correctly predict pore-pressure of a formation outside the wellbore casing at the same time as the well produces. The application requires the sensor to be cemented in place behind the casing as close to the formation as possible.

Generally, all control and access of the petroleum well is provided through a wellhead. The present invention has applications to any petroleum type wells, for example, wells located on land, on a platform, or at the seabed. However, for simplicity and to facilitate uniform understanding of the present invention, it is described herein particularly as it relates to a generic type petroleum well and its wellhead.

An aspect of the present invention is to provide a method and apparatus to obtain in-situ wellbore measurements. In certain applications, it is required to place sensors behind the well casing close to the formation. To achieve this, the need to establish a wireless link for power and communication across the wellbore casing or barrier is required. Traditionally, sensors have not been placed behind the casing due to the need for a traditional cable to provide power and communication. However, the introduction of a cable and a penetration in the casing of a well does not contribute to the pressure integrity of the barrier and is a non-optimal installation. Thus, only special applications involving a cemented section of a liner or the equivalent have been accomplished, providing sensors on the outside of the production casing.

Furthermore, and adding to the complexity, some applications of new production methods make use of the traditional annuli space (Annulus-A) as live elements of their process system. Consequently, new regulatory requirements arise and a need to move the traditional production casing barrier and well integrity outwards follows. The present invention discloses a non-intrusive method that preserves the pressure integrity of the well at the same time as it allows sensors to be placed behind the wellbore casing. Another important feature of the method and apparatus of this invention is that it allows a cluster of sensor systems to be mounted and operated on the same electrical cable downhole. Thus, a multi-sensor configuration in borehole measurement is achievable.

A second aspect of the invention is that the system is able to correct for transient offsets induced by environmental or process load changes. Typically load changes are caused by fluctuations in the process or environment temperature. This is the case of a pressure sensing device that conveys a constant volume of hydraulic fluid, such as in a pore pressure measurement application. As the temperature of a producing well changes or fluctuates, the fluid of the system and the pressure inside the containment system of a pressure sensor will expand or contract, resulting in an offset reading. The change is not critical, but simply adds to misinterpretation and erroneous monitoring of pressure over the transient period. The smaller the containment system, the larger the deviation is. To overcome this, a real-time acquisition of process and environment data in combination with the in-situ measurements constitutes an important advance over prior art in that the present invention can help management to anticipate and react to potential problems as they appear, and even before they occur. In addition, the remote sensor package can be dressed with numerous and different evaluation sensors that may be important to evaluate or filter the status and or integrity of a wellbore measurement parameter.

In accordance with one aspect of the present invention, a Wireless Sensor Unit ("WSU") is provided. The WSU is a non-intrusive in-situ measurement system provided for monitoring one or more wellbore parameters behind the casing close to the formation. A feature of the WSU is that it contains a Sensor Package ("SP") that for the purpose of illustrating this invention may consist of a sensor package to permanently monitor pressure and temperature without compromising any of the pressure integrity barriers of the well casing annuli in any way. The SP is specific for the application, and consists of a set of highly accurate quartz pressure and temperature sensor crystals and produces outputs of pressure and temperature as well as temperature gradients (i.e., change). In turn, the SP is connected to an Electromagnetic Transceiver ("ET") which includes circuitry for two-way communication and power harvesting. Both the SP and the ET are attached or integrated to the outer perimeter of a Non-Magnetic Casing Section ("NMCS") which is part of the well casing program (barrier).

Another aspect of the present invention is a Sensor Energizer Unit ("SEU") that is typically part of or attached to the well completion tubing. The SEU is adapted to host the Wireless Sensor Unit. The SEU consists of three main elements. The first and main element of the SEU is an Electromagnetic Armature ("EA"), the second element of the SEU is an Adjustable Mandrel ("AM"), and the third element of the SEU is a Cable Adaptor ("CA"). The EA provides as a combination of power source and communications link for the WSU. The principle transmission of the EA is by low frequency induction or electromagnetic ("EM") means, which is picked up and converted to electrical energy by the WSU. To ensure optimum efficiency vis-à-vis the WSU, the EA is attached to the AM, which enhances the facility or "fine tune" or optimize the efficiency to host the WSU by vertical adjustment means. Also attached to the EA is a Cable Adaptor ("CA") that connects the control cable from outside of the well. The control cable is attached to the completion tubing by traditional cable clamps and exits the well thru the wellhead, all according to prior art means. Typically, the control cable is a single-conductor Tubing Electric Cable ("TEC") type, providing power to the SEU as well as communication between the mentioned components and the monitoring facilities (i.e., outside the well).

For practical reasons the EA may be attached to an Adjustable Mandrel ("AM") that provides freedom of vertical adjustment/positioning of the EA with respect to the WSU. The freedom of vertical adjustment after being attached to the process tubing enables the operators involved to position it in an exact position adjacent to the WSU in the well without introducing "space-out" complexity, involving the completion or process tubing inside the well. Thus, the purpose of the AM is two-fold: first, to provide a holder, carrier, and/or protector for the EA; and secondly, to allow vertical adjustment so that the two main embodiments of the invention (i.e., the WSU and the SEU) are correctly arranged in relation to one another.

Depending on the type and conditions to provide a particular wellbore measurement, the SEU may also include a Sensor Package ("SP") equal to or different from that of the WSU to enhance more complex data acquisition to interpret wellbore measurements.

According to one aspect of the present invention, there is provided apparatus to provide monitoring of parameters outside the wellbore casing of a well, the apparatus including a Wireless Sensor Unit ("WSU"), placed outside a section of a non-magnetic casing, the WSU including a sensor device to measure parameters of its surroundings, wherein the WSU may be installed or positioned at any elevation of the wellbore and wherein the WSU is powered by Power Harvesting wherein the frequency of the induction signal is in the range of 10-1000 Hz for deep penetration through the non-magnetic casing; an internal Sensor Energizer Unit ("SEU") placed inside the wellbore casing, the SEU being used for power and communication with the WSU, and wherein the SEU is attached to the well tubing or completion program by tubing having a thread that allows adjustment of its elevation, and wherein the SEU converts the DC power supplied on a cable from surface to an alternating electromagnetic field that provides a source of power for the WSU outside the casing; wherein the SEU and the WSU use an electromagnetic modulation technique to provide communication of data between the two components; and wherein the SEU and the WSU are arranged to be at exactly the same elevation.

The WSU may be mounted near the wellhead or it may be mounted distally from the wellhead, far down in the formation. There may be two or more sensors in the WSU and these may all or in part be placed on the outside of the wellbore casing without compromising the pressure integrity of the well.

The sensors measure one or more parameters of the surroundings, and they may be branched off from the WSU and connected to a common electrical wire harness attached to the outside of the casing. The wiring harness is either a single or multi-conductor type downhole Tubing Electric able ("TEC").

The sensor or sensors of the WSU may be of a permanent type which may be cemented in place directly facing the formation, or which may be open hole and directly facing the formation. Alternatively, the WSU and its sensor configuration may be part of a wellbore pressure containment system in the annulus and may be facing an outer wellbore casing or cemented in place facing an outer wellbore casing.

The apparatus may further include one or more power harvesting coils spaced out over a given section of the non-magnetic casing. The coils or a band of the non-magnetic casing may provide the required completion or space-out tolerance for the system when landing the well tubing or tubing-hanger in the wellhead or tree.

The WSU may additionally include or be connected to a secondary energy source, which may be a battery or a downhole generator, for example.

The SEU may further include one or more sensors to measure parameters inside the wellbore casing or tubing to which it is attached and these sensors may be an integral part of the SEU, or they may be branched-off from the SEU and connected to a common electrical wiring harness, or the sensor system may be a combination of integral sensors and sensors branched-off. When present, the wire harness may be a single-conductor or multi-conductor type downhole Tubing Electric Cable (TEC).

The sensors of the present invention may measure parameters relating to the well process, its structural components, or formation parameters.

Examples of well process properties which may be measured include: pressure, temperature, flow quantity, flow velocity, flow direction, turbidity, composition, oil level, oil-water interface level, density, salinity, displacements, vibrations, pH, resistivity, radioactivity, sand content, thermal conductivity, as well as other chemical and physical properties, or any combination thereof.

Examples of structural components of the wellbore which may be measured include: shock, vibrations, inclinations, magnetic properties, electrical properties, tool-face or other type of tool orientation, as well as stress and strain properties, or any combination thereof.

Examples of formation or open hole properties outside the wellbore casing which may be measured include: pressure, temperature, radioactivity, resistivity, density, pH, salinity, electromagnetic and/or electrical fields, sound, sound velocity, thermal conductivity, as well as other chemical and physical properties, or any combination thereof.

The apparatus may further include means to induce a response from the surroundings, which means may be selected from: a magnetic field source, an electric field source, sound waves, pressure, temperature, shear-force waves, other final element or actuator part of downhole process control, or a final element or actuator used towards formation to assist any of above listed measurements, or any combination thereof.

The apparatus may also additionally further include one or more of: noise cancelling of parameter offsets due to offset created by the well process or environment; or prediction and correction of measurements due to thermal and pressure gradients within the system.

The invention also extends to a method of monitoring parameters outside the wellbore casing of a well, the method including: installing a Wireless Sensor Unit ("WSU"), including a sensor device to measure parameters of its surroundings, at a location outside a section of a non-magnetic casing, in which the WSU may be installed or positioned at any elevation of the wellbore; installing an internal Sensor Energizer Unit ("SEU") inside the wellbore casing, the SEU being used for power and communication with the WSU, wherein the SEU is attached to the well tubing or completion program by tubing having a thread that allows adjustment of its elevation; arranging the SEU and the WSU to be at exactly the same elevation; powering the WSU by Power Harvesting wherein the frequency of the induction signal is in the range of 10-1000 Hz for deep penetration through the non-magnetic casing; converting the DC power supplied on a cable from the surface to an alternating electromagnetic field that provides a source of power for the WSU outside the casing; and using an electromagnetic modulation technique to provide communication of data between the WSU and the SEU.

Optional and preferred features of the apparatus as discussed above apply equally to the method of the present invention and will be discussed further in the specific description below.

DESCRIPTION OF THE DRAWINGS

These and other features and advantages of the present invention will be appreciated and understood by those skilled in the art from the detailed description and drawings. Referring now to drawings, wherein like elements are numbered alike in the several FIGS.

DETAILED DESCRIPTION OF THE PREFERRED EMBODIMENT

Figure 1:
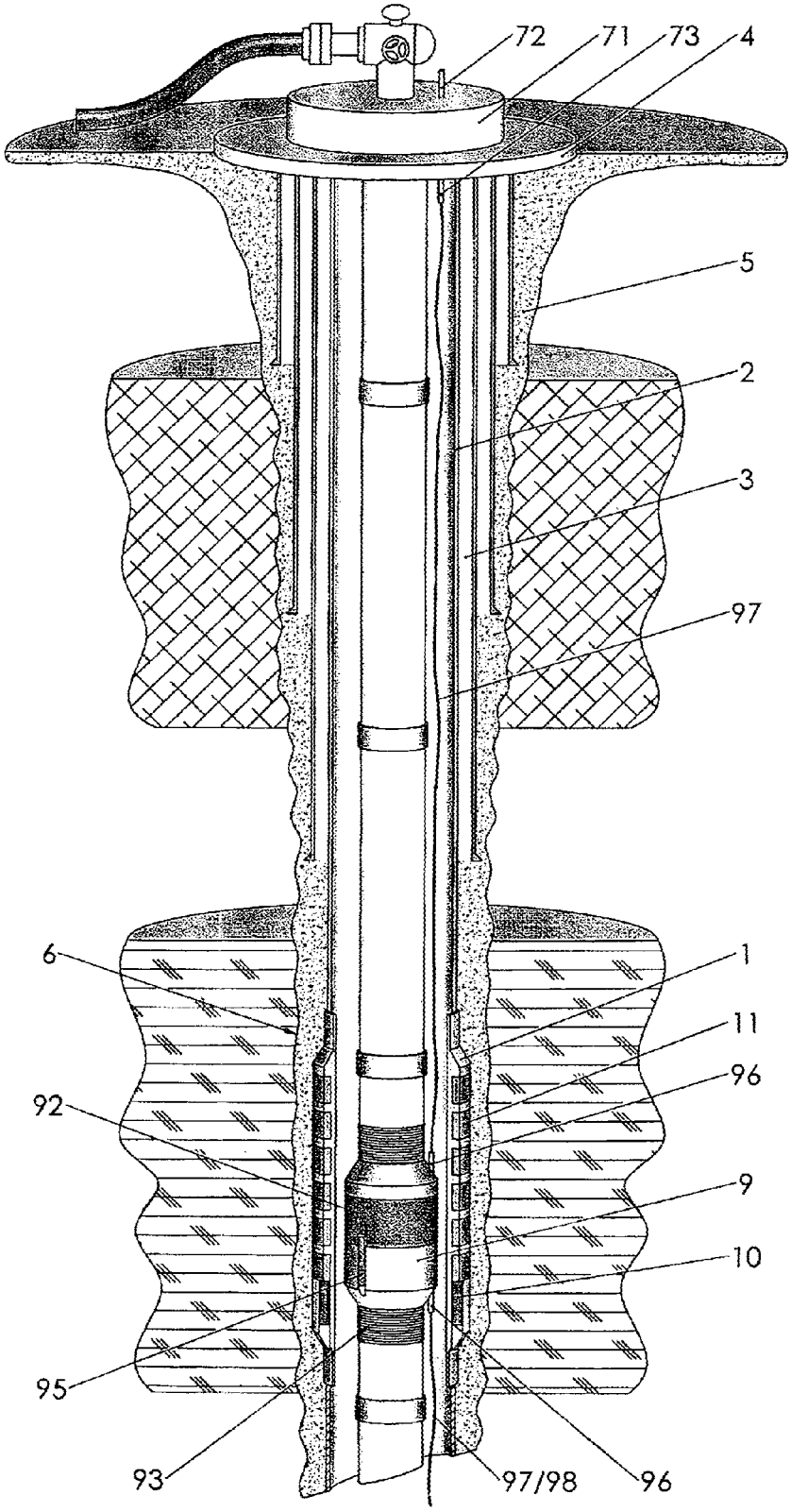
FIG. 1 is a diagrammatic view depicting the method and apparatus of the present invention for use in in-situ wellbore Measurements.

This invention relates to in-situ wellbore measurements. The object is to place one or more sensors in and around a wellbore in order to measure one or more physical parameters or properties of a formation. The most common or frequent parameters to monitor are one or both of pressure and temperature at a target elevation within a reservoir or formation. In particular a Wireless Sensor Unit ("WSU") 1 in the present invention is made part of the casing program of the main production barrier 2 of the well. Referring to FIG. 2, a Casing Section 20 of the WSU 1 is made of a non-magnetic material and hosts a Sensor Package 10 and a plurality of Electromagnetic Transceivers 11*a-f*. For the purpose of this invention, the Sensor Package 10 is configured to measure and monitor the annular space outside the main production barrier 2 of the well producing system (shown in FIG. 1).

Referring again to FIG. 1, this annular space 3 is also often referred to as Annulus-B, and the WSU 1 is typically positioned close to and underneath the wellhead structure or housing 4. The wellhead structure 4 is shown here in context, with the reference numeral 5 depicting the earth through which the well has been bored, and where the reference numeral 6 depicts the wellbore. The WSU 1 is wirelessly powered by a Sensor Energizer Unit ("SEU") 9 by electromagnetic means, also referred to herein as "power harvesting" (referred to as reference numeral 100 in FIG. 4) by those who are skilled in the art of electrical engineering. The WSU 1 is provided with supervisory circuits that enable two-way communications with the SEU 9. In turn, the communication is by electromagnetic means.

FIG. 2 shows the main elements of one component of the present invention in greater detail, which together define the configuration of the Wireless Sensor Unit ("WSU") 1. The WSU 1 consists of a Sensor Package ("SP") 10, an Electromagnetic Transceiver ("ET") 11*a-f*, and a Non-Magnetic Casing Section ("NMCS") 20. A more detailed connection and function diagram of the WSU 1 is illustrated on the right hand side of the dotted line of FIG. 4.

Figure 3:
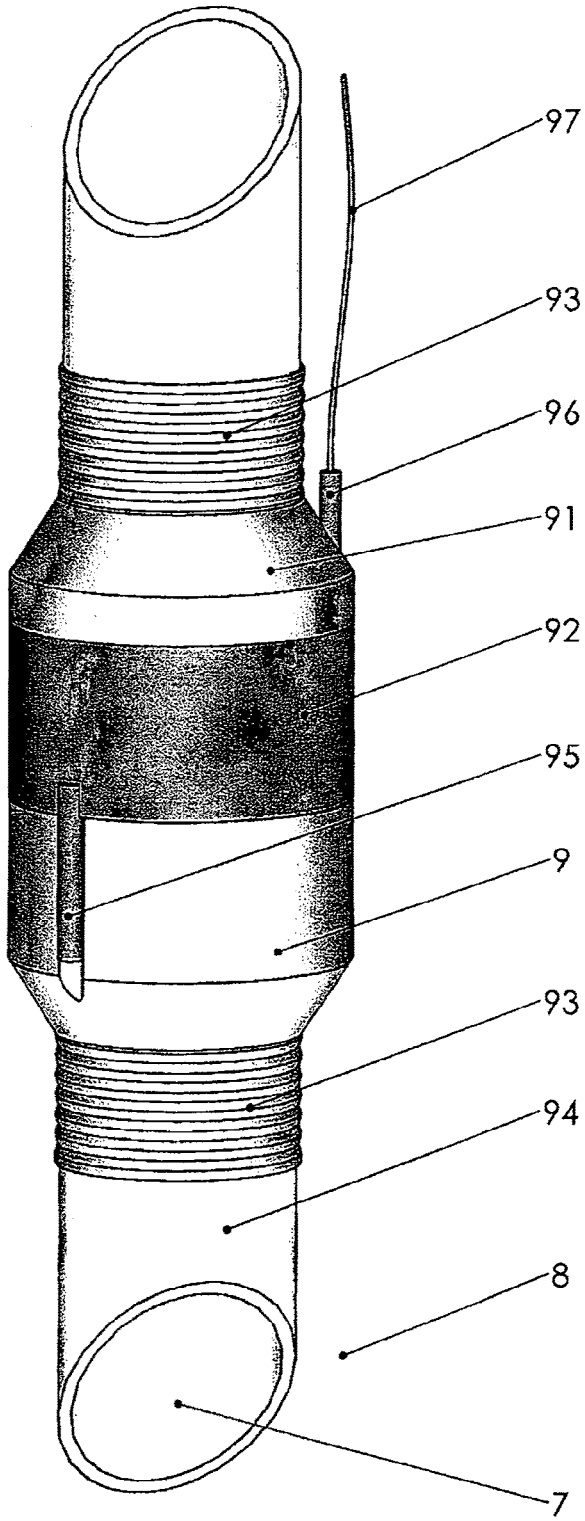
FIG. 3 shows an enlarged diagrammatic view of another aspect of FIG. 1, depicting the Sensor Energizer Unit ("SEU")

Referring to FIG. 3, a second component of the present invention is the Sensor Energizer Unit ("SEU") 9. The SEU 9 is typically mounted to a mandrel 91 and attached to a section of the production tubing 94. For the present illustration, the production tubing 94 is provided with an external thread 93, although this could equally be an internal thread. The external thread 93 allows the elevation of the SEU 9 to be adjusted so that the elevation of the SEU 9 in the well corresponds exactly with the elevation of the WSU 1. This will ensure proper communications as well as providing optimum efficiency of the power harvesting (reference 100 in FIG. 4).

Figure 2:
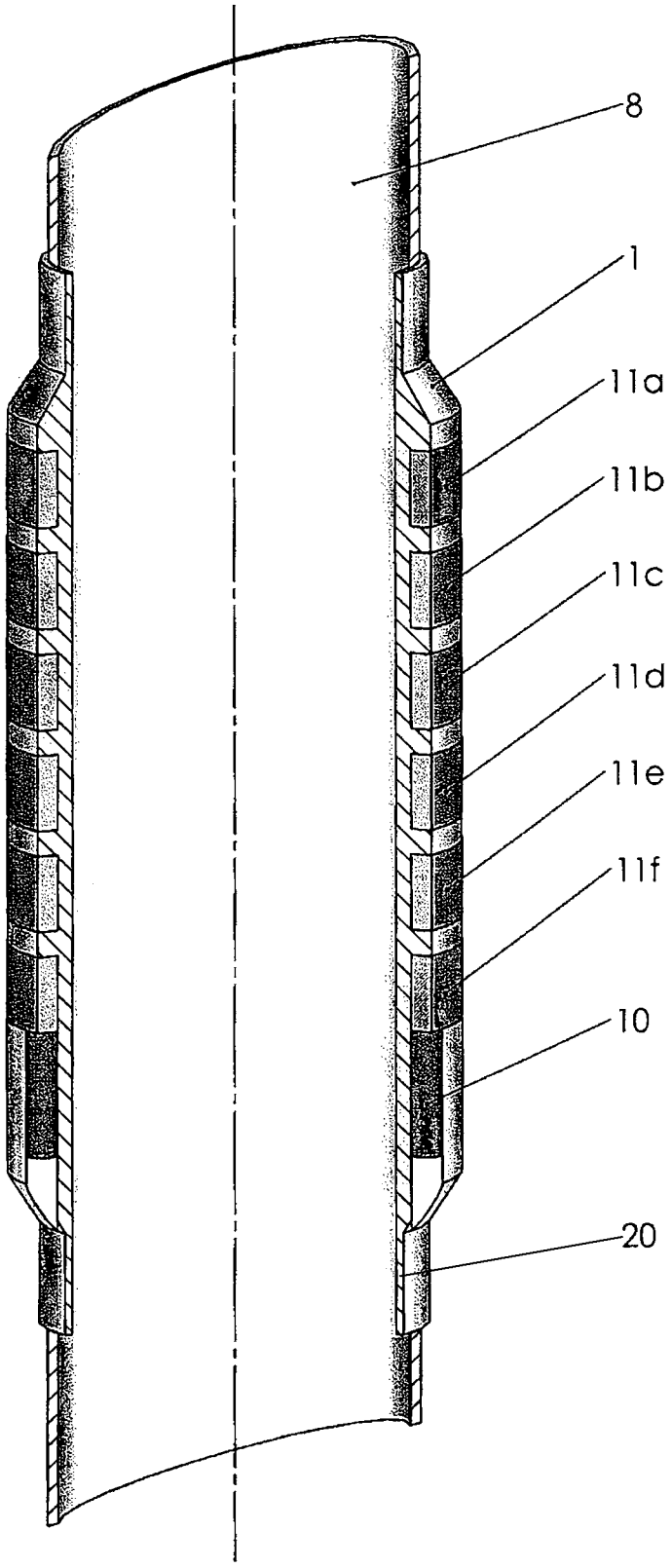
FIG. 2 shows an enlarged diagrammatic view of one aspect of FIG. 1, depicting the Wireless Sensor Unit ("WSU")

Power supply and communications for the SEU are provided through the Tubular Electric Cable ("TEC") 97 which is attached to the process tubing 7 and a feedthrough identified by the reference numerals 72 and 73 (shown in FIG. 1), typically exiting at a tubing hanger 71 (also shown in FIG. 1). The SEU 9 may also host a Sensor Package 95 (shown in FIG. 3), which in principle is the same as the Sensor Package 10 of the WSU 1, but which may be configured to read parameters of the inner annulus 8. Typically, the inner annulus 8 is often referred to as Annulus-A by those skilled in the art, otherwise this is below the production packer of the well.

Figure 4:
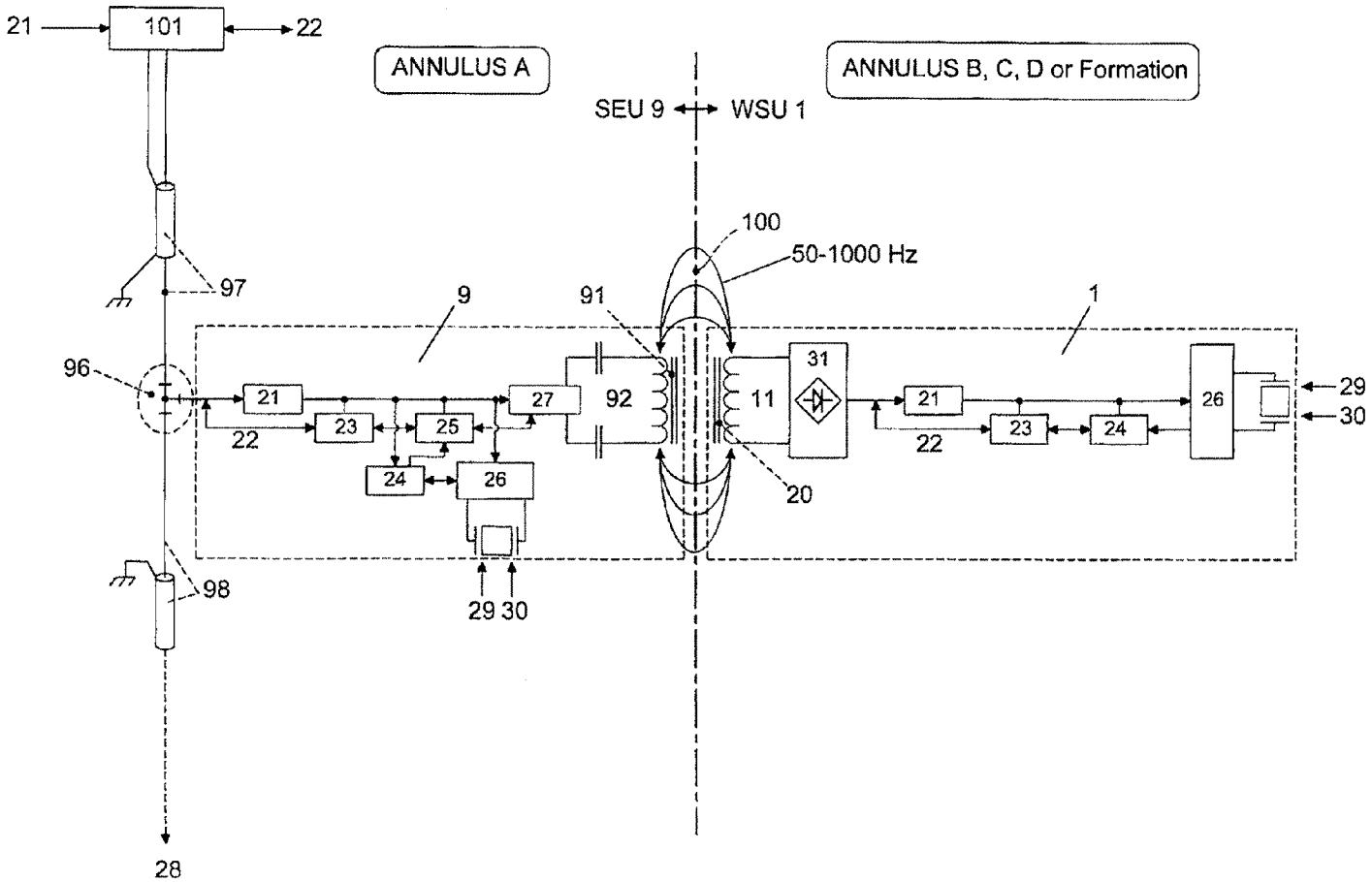
FIG. 4 shows a simplified electrical block diagram of the pressure management system in accordance with the present invention.

Referring to FIGS. 3 and 4, power to the SEU 9 is provided from the well site mounted Downhole Interface Unit ("DIU") 101 through a Tubing Electric Cable conduit ("TEC") 97. The TEC 97 also hosts the communication in and out of the well between the DIU 101 and the SEU 9. Typically, the communication is by means of a signal superimposed onto the power since the TEC 97 is a single-conductor cable. The TEC 97 is terminated at the SEU 9 in a Cable Adaptor 96. Power is routed internally through the mandrel 91 and is connected to an Electromagnetic Armature ("EA") 92. A detailed description of the internal electronic functions and routing is provided in FIG. 4, referring to the components on the left hand side of the dotted line.

Also, if required a Sensor Package ("SP") 95 may be adapted to provide more data for the evaluation of the pressure integrity of the annuli of interest. The SP 95 may be the same as the SP 10 of the WSU, but it may alternatively be any kind of sensor capable of providing data to enhance safety and risk assessment of a particular well.

For example, the SP 95 could measure one or more of the following properties: pressure, temperature, flow quantity, flow velocity, flow direction, turbidity, composition, oil level, oil-water interface level, density, salinity, radioactivity, displacement, vibrations, pH, resistivity, sand content, and thermal conductivity, as well as other chemical and physical properties.

As mentioned, the EA 92 and the SP 95 may be attached to the mandrel 91. The mandrel 91 serves as both a holder for and protection of the mentioned elements and allows for adjustment to match the vertical position or elevation of WSU 1. The adjustment range of the present invention is typically in the range 0-50 cm, for example 10-40 cm or 25-35 cm, but may be more or less depending upon the requirement to provide freedom of proper space-out for the installation. Both the mandrel 91 and the process tubing 94 may be manufactured in a magnetic material.

Referring now to FIG. 4, a simplified electronic block diagram of the present invention is provided for those skilled in the art in order to visualize the inherent architecture as well as the operation of the system. As may be seen from the block diagram, one or more of the SEU 9 units may be attached to the control cable 97.

In this FIG. 4, this is illustrated using an additional TEC 98 that leads to one or more additional SEU units shown generally by the reference numeral 28. In a multi-unit system (i.e., two or more SEU units 9 or 28), each SEU unit 9 or 28 is connected in a parallel configuration onto the cable 97. Due to relatively high power consumption, the nature of the system is also that only one of the SEU units 9 or 28 is active at a given time.

The active status of an SEU 9 or 28 is addressed during the initial start-up and through a command issued by the DIU 101 at the well site. At power-up, the DIU 101 actively addresses one of the SEU units 9 or 28 on the line and makes it the active node of the system. To change to another SEU 9 or 28, the DIU 101 simply powers-down the line to reset or resume. At the next power-up another SEU 9 or 28 may be addressed. Using this mode of operation, power is directed to one SEU 9 or 28 at a time, and the system is capable of hosting many SEU units 9 and 28 on the line without gross voltage drop on the TEC's 97 or 98 due to heavy loads.

Power harvesting 100 is achieved by correct vertical alignment of the SEU 9 in relation to the WSU 1. As mentioned above, this adjustment is provided by the adjustable mandrel 91. A second requirement and feature of this invention is the use of the non-magnetic casing section ("NMCS") 20 which makes the lower frequency (50-1000 Hz) electromagnetic field induced by the Electromagnetic Armature ("EA") 92 deep penetrating, and thus visible to the Electromagnetic Transceiver ("ET") 11 of the WSU 1. The efficiency of the power transfer is poor due to non-ideal conditions of the induction coupling, however tests show that a ratio in the range of 20:1 is achievable and is sufficient to operate a low-power sensor package as described in the present invention.

Referring again to FIG. 4 in detail, the SEU consists of a Power Supply 21 that provide a regulated DC current for the electronic functions of the unit. The SEU 9 is supervised by an internal Controller 25. Upon a wake-up call, the Controller 25 makes the address interpretation, and when addressed it turns on an internal Modulating Chopper Oscillator ("MCO") 27. The MCO 27 converts electrical energy into an alternating magnetic field through the Electromagnetic Armature 92. The induced field has a frequency that enables electromagnetic waves to propagate deeply into the surrounding structures, and thereafter be picked up by the Electromagnetic Transceiver ("ET") 11*a-f* of the WSU 1. The MCO 27 also assists in modulating data 22 in between the SEU 9 and the WSU 1.

The SEU 9 also has a Modem 23. The main purpose of the Modem 23 is to read and transmit data 22 from and to the power line 97. However, the data going in and out of the SEU 9 is buffered and interpreted by the internal Controller 25. Crystal Sensors may be used for detecting pressure using a Crystal Sensor 29 and temperature using a Crystal Sensor 30 in the described device, and are driven by the respective Oscillators 26 and each sensor crystal provides a frequency output as function of its measurand. The sensor frequency is measured by a Signal Processor 24 and is continuously feed to an input buffer of the Controller 25.

For the WSU 1, the internal electronic functions are equivalent to these for the SEU 9 with the exception of a Rectifying Bridge 31. The Rectifying Bridge 31 converts the alternating current induced by the local electromagnetic field into a DC voltage/current that internally powers the WSU 1. The prescribed electromagnetic principle used is referred to as Power Harvesting 100 by persons skilled in the art. For the purpose of this invention, the WSU 1 may be provided with highly accurate sensors for detecting pressure using a Crystal Sensor 29 and temperature using a Crystal Sensor 30*s*. In principle, the WSU 1 may include a Sensor Package that may hold any kind of sensors to measure a plurality of measurement parameters outside the wellbore casing 2 or barrier.

FIGS. 1 to 4 have generally shown a system including either a single sensor within the SEU 9 or two sensors, one within the SEU 9 and the other in the WSU 1.

Figure 5:
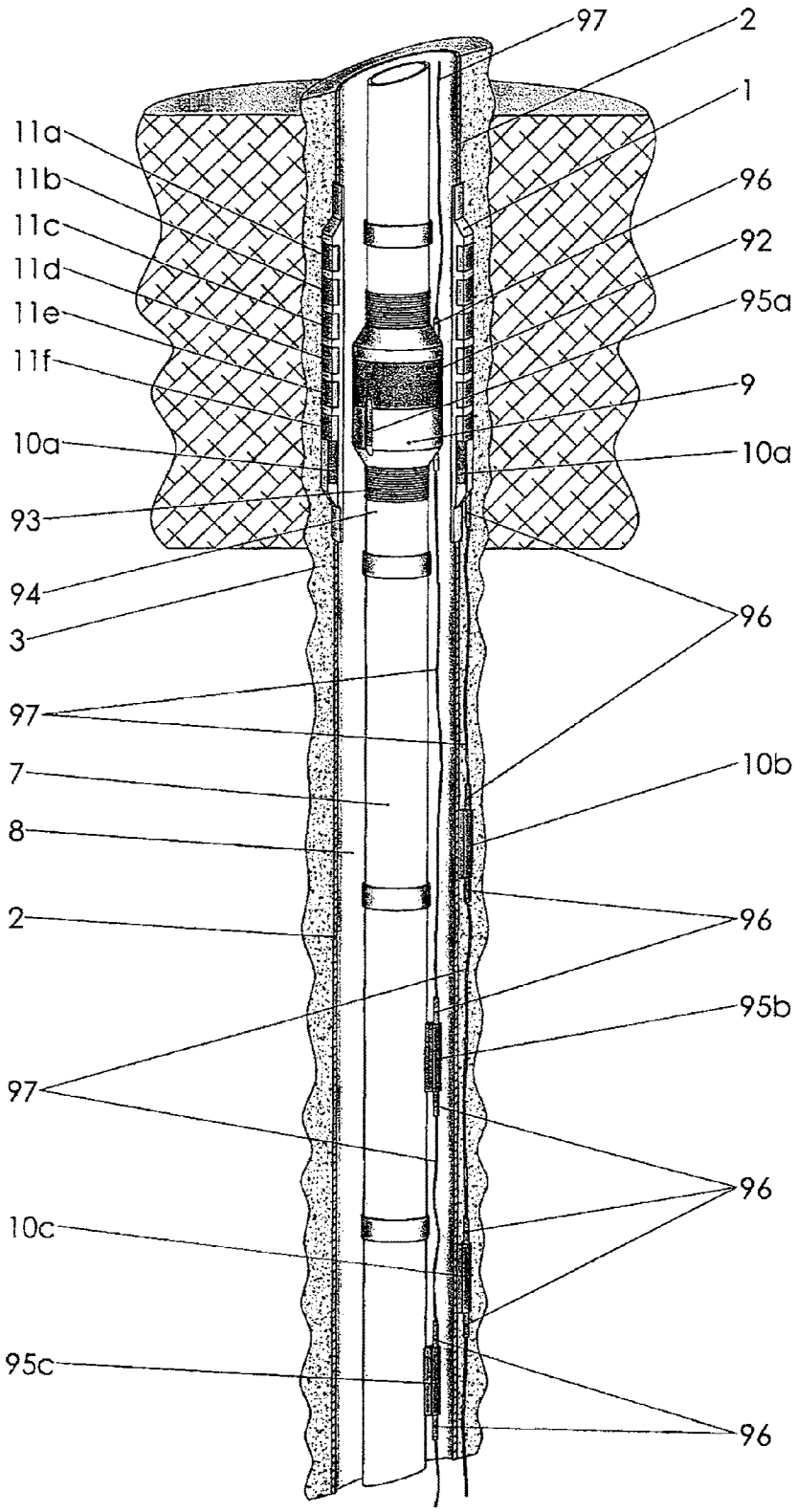
FIG. 5 is a diagrammatic view similar to FIG. 1, but showing the use of multiple sensors on either side of the wellbore casing.

FIG. 5 shows the system described by FIG. 1 expanded to include more sensors on either side of the wellbore casing 2. Similar reference numerals are used for similar features as in those described with reference to FIGS. 1 to 4. On the inside, branched-off from the SEU 9 are three sensors 95*a*, 95*b* and 95*c*, for example, and on the outside, branched-off from the WSU are three further sensors 10*a*, 10*b* and 10*c*, for example.

Figure 6:
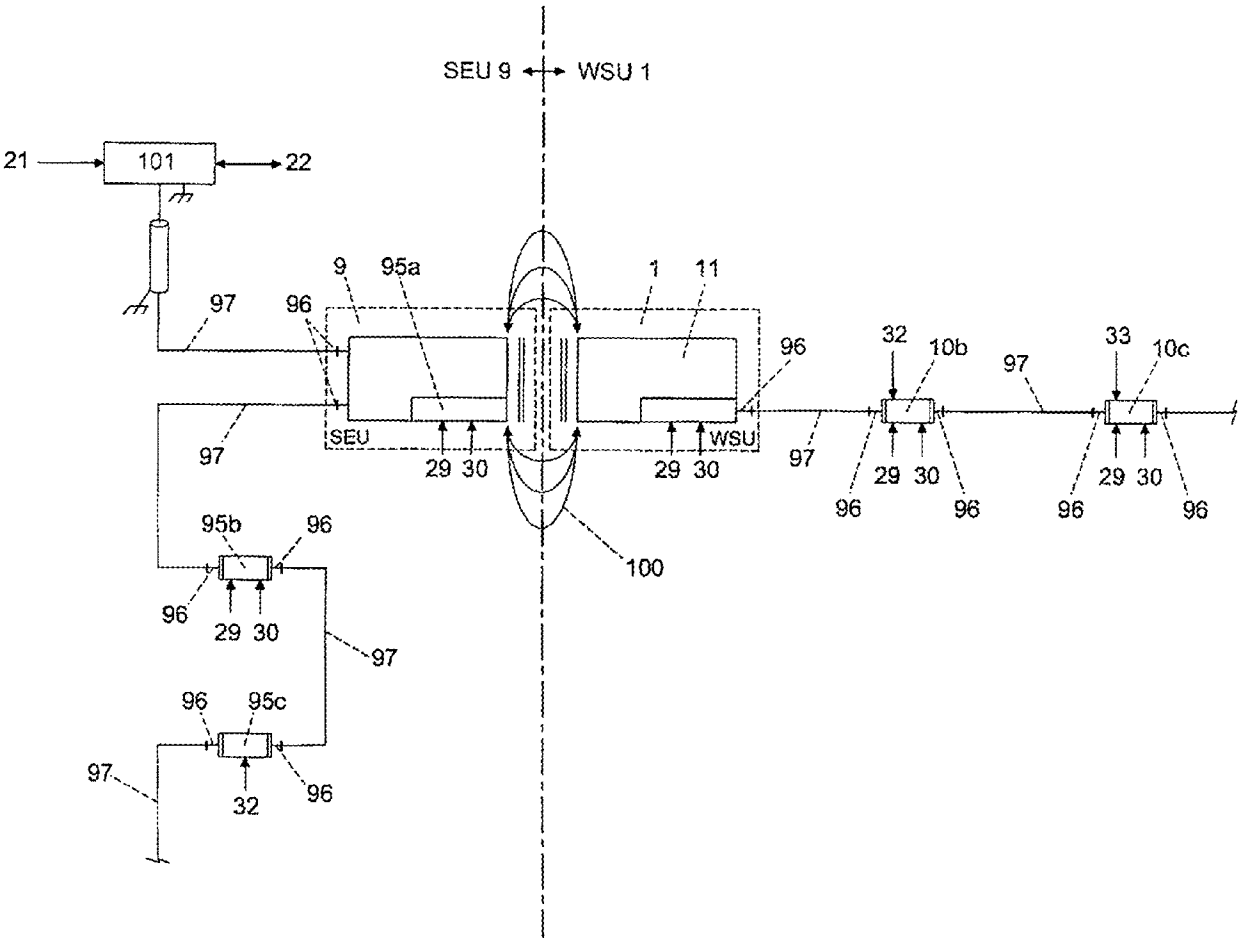
FIG. 6 is a block diagram showing a sensor network running from a single note.

FIG. 6 is the corresponding schematic block diagram showing the multiple sensors networked to operate from a single-node, and illustrates the cascading of sensors on both sides of the wellbore casing 2. Referring to FIG. 6, the sensors are depicted measuring open hole properties, for example, pressure using a sensor 29, temperature using a sensor 30, resistivity using a sensor 32, and the oil-water interface level using a sensor 33.

Figure 7:
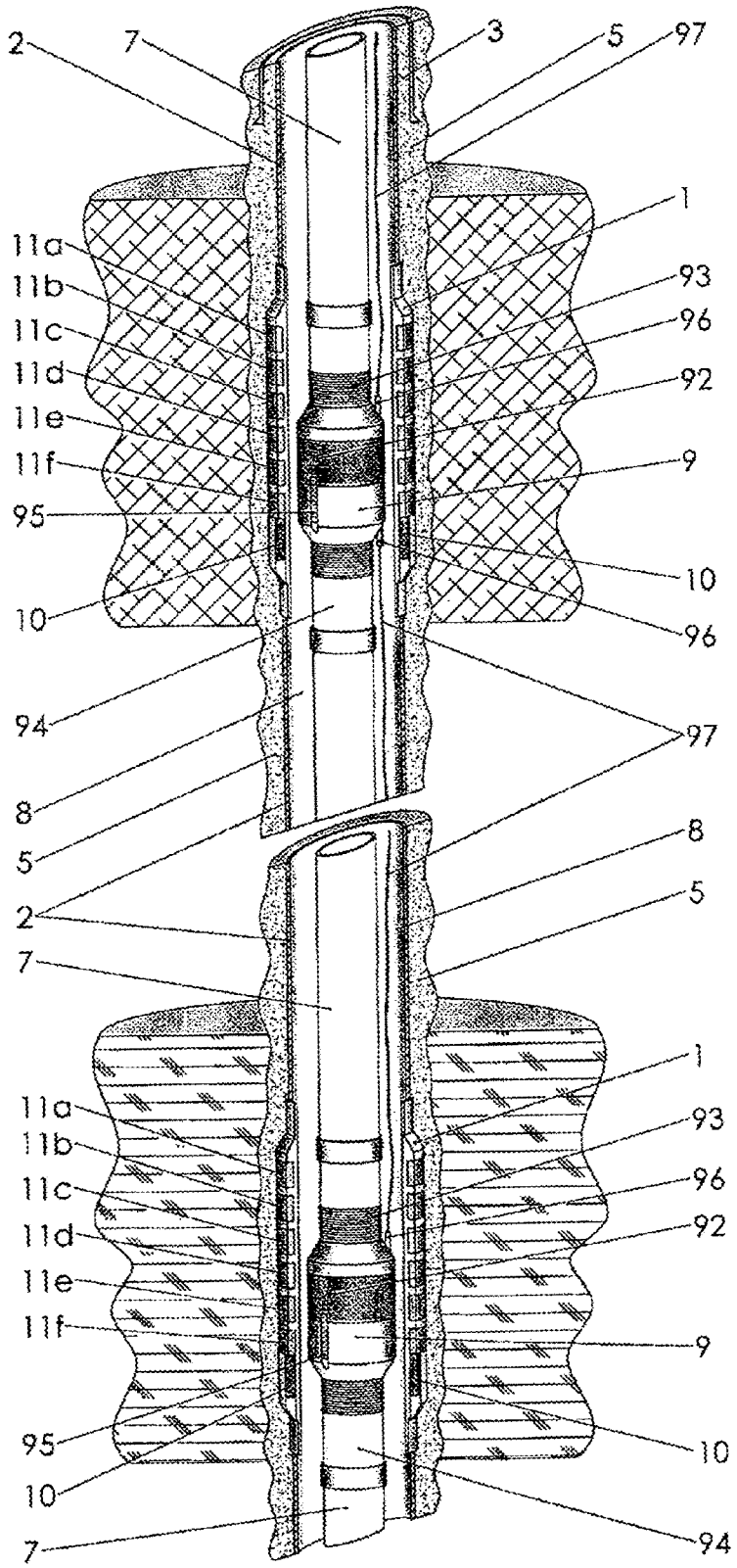
FIG. 7 is a diagrammatic view similar to FIG. 1, showing the use of multiple sensors on a single down hole cable.

FIG. 7 shows the system described by FIG. 1 expanded to include multiple nodes by means of two or more sets of SEU's 9 and WSU's 1 installed. Similar reference numerals are used for similar features as in FIGS. 1 to 4. On the inside, and operated on the same cable 97, are shown two SEU's 9 which have associated WSU's 1 at corresponding elevations externally of the wellbore. In the figure, both WSU's 1 are facing the formation, but it would be possible to have both facing inwards or have one facing inwards and one facing the formation.

Figure 8:
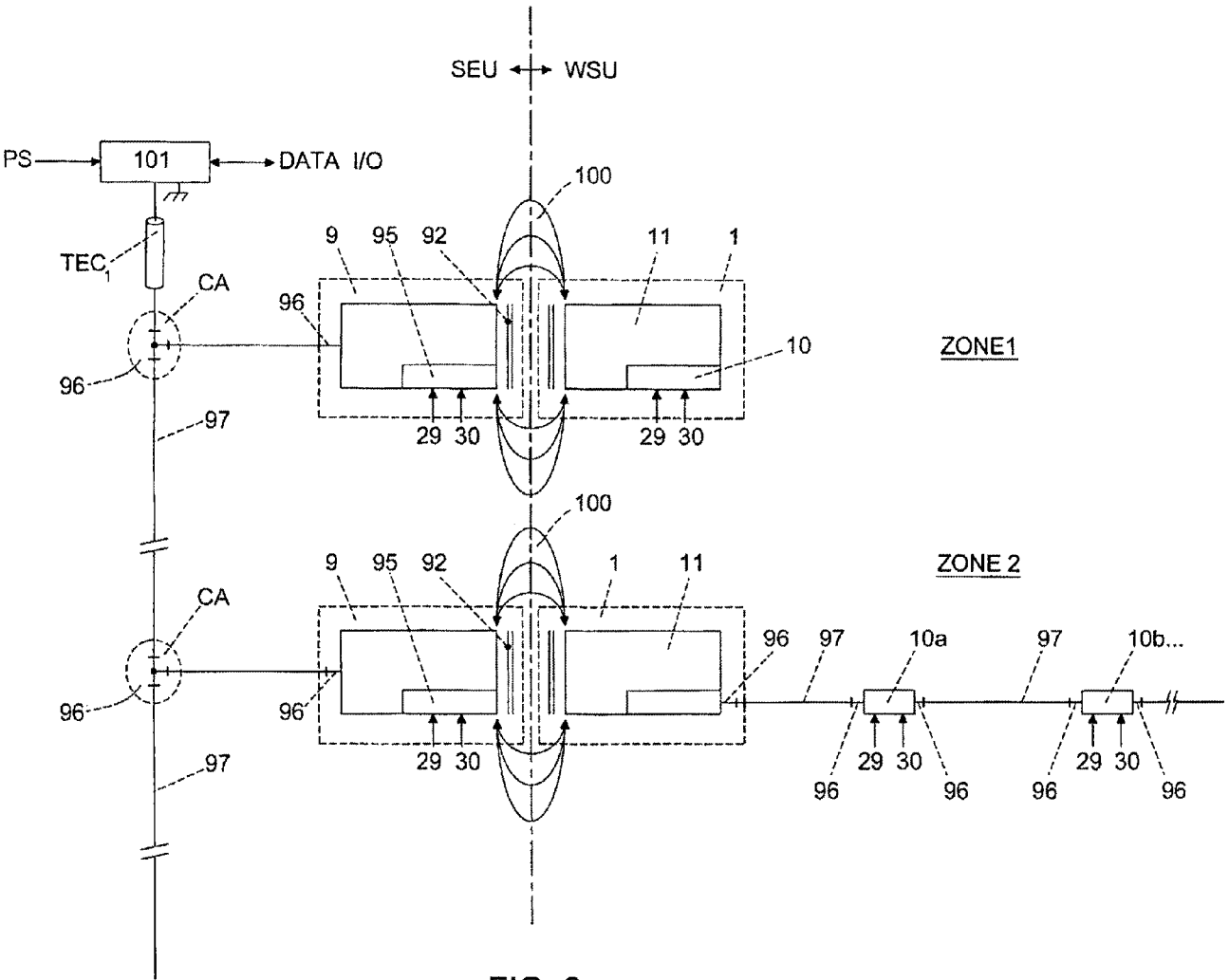
FIG. 8 is a block diagram showing the sensor network of FIG. 7.

FIG. 8 is the corresponding schematic block diagram showing the multiple sensors on the multiple WSU's 1, associated with the multiple SEU's 9 all operated off the one cable 97. Referring to FIG. 8, the sensors are depicted measuring open hole properties, for example, pressure using sensors 29 and temperature using sensors 30.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. Apparatus to provide monitoring of parameters outside the wellbore casing of a well, said apparatus comprising:

a Wireless Sensor Unit ("WSU"), placed outside a section of a non-magnetic casing, said WSU including a sensor device to measure parameters of its surroundings, wherein the WSU may be installed or positioned at any elevation of a wellbore and wherein the WSU is powered by Power Harvesting where the frequency of an induction signal is in the range of 10-1000 Hz for deep penetration through the non-magnetic casing;

an internal Sensor Energizer Unit ("SEU") for placement inside the wellbore casing, said SEU being used to provide power and communication with the WSU, and wherein the SEU is attached to the well production tubing on a process tubing segment having a thread that allows adjustment of said SEU's elevation, and wherein the SEU converts DC power supplied by a cable from the surface to an alternating electromagnetic field that provides a source of power for the WSU outside the wellbore casing;

wherein the SEU and WSU use an electromagnetic modulation technique to provide communication of data between the two components; and wherein the SEU and the WSU are arranged to be at exactly the same elevation.

2. Apparatus as claimed in claim 1, wherein the WSU is arranged and configured for mounting near a wellhead.

3. Apparatus as claimed in claim 1, wherein the WSU is arranged and configured for mounting distally from a wellhead, far down in a formation.

4. Apparatus as claimed in claim 1, wherein the WSU and its sensor device is cemented in place in the wellbore directly facing the formation.

5. Apparatus as claimed in claim 1, wherein the WSU and its sensor device is open hole and directly faces a formation.

6. Apparatus as claimed in claim 1, wherein the WSU and its sensor device are part of a wellbore pressure containment system in an annulus located between the wellbore casing and an outer wellbore casing.

7. Apparatus as claimed in claim 1, further comprising means to induce a response from the surroundings, which means may be selected from the group consisting of:

a magnetic field source, an electric field source, sound waves, pressure, temperature, shear-force waves, another final element or actuator part of downhole process control, and a final element or actuator used towards formation to assist any of the previously listed measurements.

8. Apparatus as claimed in claim 1, further comprising one or more of:

apparatus for performing one or more of: noise cancelling of parameter offsets due to offset created by the well process or environment; and prediction and correction of measurements due to thermal and pressure gradients within the system.

9. Apparatus as claimed in claim 1, wherein the WSU further comprises one or more power harvesting coils spaced out over a given section of the non-magnetic casing.

10. Apparatus as claimed in claim 9, wherein the power harvesting coils or a band of the non-magnetic casing provides the required completion or space-out tolerance when landing the well production tubing or a tubing-hanger in a wellhead or tree.

11. Apparatus as claimed in claim 1, wherein the WSU comprises or is connected to a secondary energy source.

12. Apparatus as claimed in claim 11, wherein the secondary energy source is selected from the group consisting of a battery and a downhole generator.

13. Apparatus as claimed in claim 1, wherein the SEU further comprises one or more sensors to measure parameters inside the wellbore casing or the well production tubing to which they are attached.

14. Apparatus as claimed in claim 13, wherein the sensors are either or both an integral part of the SEU, or branched-off from the SEU and connected to a common electrical wiring harness.

15. Apparatus as claimed in claim 14, wherein the wire harness is a single-conductor or a multi-conductor type downhole Tubular Electric Cable ("TEC").

16. Apparatus as claimed in claim 13, wherein the sensors measure parameters relating to the well process, its structural components, or formation parameters.

17. Apparatus as claimed in claim 16, wherein the sensors measure one or more of the following well process properties:

pressure, temperature, flow quantity, flow velocity, flow direction, turbidity, composition, oil level, oil-water interface level, density, salinity, displacements, vibrations, pH, resistivity, radioactivity, sand content, thermal conductivity, as well as other chemical and physical properties.

18. Apparatus as claimed in claim 16, wherein the sensors measure one or more of the following structural components of the wellbore:

shock, vibrations, inclinations, magnetic properties, electrical properties, tool-face or other type of tool orientation, as well as stress and strain properties.

19. Apparatus as claimed in claim 1, wherein there are two or more sensors in the sensor device of the WSU.

20. Apparatus as claimed in claim 19, wherein the sensors measure one or more of the following formation or open hole properties outside the wellbore casing:

pressure, temperature, radioactivity, resistivity, density, pH, salinity, electro-magnetic and/or electrical fields, sound, sound velocity, thermal conductivity, as well as other chemical and physical properties.

21. Apparatus as claimed in claim 19, wherein all of the sensors of the WSU are arranged and configured for placement on the outside of the wellbore casing without compromising the pressure integrity of the well.

22. Apparatus as claimed in claim 19, wherein the sensors measure one or more parameters of their surroundings.

23. Apparatus as claimed in claim 19, wherein the sensors of the WSU are of a permanent type.

24. Apparatus as claimed in claim 23, wherein the WSU and its sensor device are cemented in place facing an outer wellbore casing.

25. Apparatus as claimed in claim 4, wherein the sensors are branched off from the WSU and connected to a common electrical wire harness attached to the outside of the wellbore casing.

26. Apparatus as claimed in claim 25, wherein the wiring harness is either a single-conductor or multi-conductor type downhole Tubular Electric Cable ("TEC").

27. A method of monitoring parameters outside the wellbore casing of a well, said method comprising:

installing a Wireless Sensor Unit ("WSU"), including a sensor device to measure parameters of its surroundings, at a location on the outside of a section of a non-magnetic casing, in which the WSU may be installed or positioned at any elevation of a wellbore;

installing an internal Sensor Energizer Unit ("SEU") inside the wellbore casing, said SEU being used for power and communication with the WSU, and wherein the SEU is attached to the well production tubing on a process tubing having a thread that allows adjustment of said SEU's elevation;

arranging the SEU and the WSU to be at exactly the same elevation;

powering the WSU where the frequency of an induction signal is in the range of 10-1000 Hz for deep penetration through the non-magnetic casing;

converting DC power supplied by a cable from surface to an alternating electromagnetic field that provides a source of power for the WSU outside the wellbore casing; and using an electromagnetic modulation technique to provide communication of data between the WSU and the SEU.

28. A method as claimed in claim 27, wherein the WSU is mounted near a wellhead.

29. A method as claimed in claim 27, wherein the WSU is mounted distally from a wellhead, far down in a formation.

30. A method as claimed in claim 27, further comprising the step of:

inducing a response from the surroundings, which inducement may be by any means suitable for inducing any one or more of: a magnetic field, an electric field, sound waves, pressure, temperature, shear-force waves, another final element or actuator part of downhole process control, and a final element or actuator used towards formation to assist any of the previously listed measurements.

31. A method as claimed in claim 27, further comprising one or more of the following steps:

noise cancellation of parameter offsets due to offset created by the well process or environment; and prediction and correction of measurements due to thermal and pressure gradients within the system.

32. A method as claimed in claim 27, wherein the WSU further comprises one or more power harvesting coils spaced out over a given section of the non-magnetic casing.

33. A method as claimed in claim 32, wherein the power harvesting coils or a band of the non-magnetic casing provides the required completion or space-out tolerance when landing the well production tubing or a tubing-hanger in a wellhead or tree.

34. A method as claimed in claim 27, wherein the WSU comprises or is connected to a secondary energy source.

35. A method as claimed in claim 34, wherein the secondary energy source is selected from the group consisting of a battery and a downhole generator.

36. A method as claimed in claim 27, wherein the SEU further comprises one or more sensors to measure parameters inside the wellbore casing or the well production tubing to which they are attached.

37. A method as claimed in claim 36, wherein the sensors are either or both an integral part of the SEU, or branched-off from the SEU and connected to a common electrical wiring harness.

38. A method as claimed in claim 37, wherein the wire harness is a single-conductor or a multi-conductor type downhole Tubular Electric Cable ("TEC").

39. A method as claimed in claim 36, wherein the sensors measure parameters relating to the well process, its structural components, or formation parameters.

40. A method as claimed in claim 39, wherein the sensors measure one or more of the following well process properties:

pressure, temperature, flow quantity, flow velocity, flow direction, turbidity, composition, oil level, oil-water interface level, density, salinity, displacements, vibrations, pH, resistivity, radioactivity, sand content, thermal conductivity, as well as other chemical and physical properties.

41. A method as claimed in claim 39, wherein the sensors measure one or more of the following structural components of the wellbore:

shock, vibrations, inclinations, magnetic properties, electrical properties, tool-face or other type of tool orientation, as well as stress and strain properties.

42. A method as claimed in claim 27, wherein there are two or more sensors in the sensor device of the WSU.

43. A method as claimed in claim 42, wherein the sensors measure one or more of the following formation or open hole properties outside the wellbore casing:

pressure, temperature, radioactivity, resistivity, density, pH, salinity, electro-magnetic and/or electrical fields, sound, sound velocity, thermal conductivity, as well as other chemical and physical properties.

44. A method as claimed in claim 42, wherein all of the sensors in the sensor device of the of the WSU are placed on the outside of the wellbore casing without compromising the pressure integrity of the well.

45. A method as claimed in claim 42, wherein the sensors measure one or more parameters of their surroundings.

46. A method as claimed in claim 42, wherein the sensors are branched off from the WSU and connected to a common electrical wire harness attached to the outside of the wellbore casing.

47. A method as claimed in claim 43, wherein the wiring harness is either a single-conductor or multi-conductor type downhole Tubular Electric Cable ("TEC").

48. A method as claimed in claim 42, wherein the sensors of the WSU are of a permanent type.

49. A method as claimed in claim 48, wherein the WSU and its sensor configuration is cemented in place directly facing the formation.

50. A method as claimed in claim 48, wherein the WSU and its sensor device is open hole and directly faces a formation.

51. A method as claimed in claim 48, wherein the WSU and its sensor device are part of a wellbore pressure containment system in an annulus located between the wellbore casing and an outer wellbore casing.

52. A method as claimed in claim 48, wherein the WSU and its sensor device are cemented in place facing an outer wellbore casing.

* * * * *